United States Patent [19]

Gallot et al.

[11] Patent Number: 4,671,222

[45] Date of Patent: Jun. 9, 1987

[54] VALVE ACTUATING DEVICE IN AN INTERNAL COMBUSTION ENGINE HAVING FOUR VALVES INCLINED IN A V CONFIGURATION AND A CENTRAL SPARK PLUG PER CYLINDER

[75] Inventors: Jean-Claude Gallot, Argenteuil; Pierre Lauvin, Andresy; Roger Lombard, Noisy-Le-Sec, all of France

[73] Assignees: Automobiles Peugeot, Paris; Automobiles Citroen, Neuilly-Sur-Seine, both of France

[21] Appl. No.: 837,693

[22] Filed: Mar. 10, 1986

[30] Foreign Application Priority Data

Mar. 13, 1985 [FR] France ..... 85 03709

[51] Int. Cl.[4] ..... F01L 1/26

[52] U.S. Cl. ..... 123/90.27; 123/90.23; 123/90.4; 123/90.43; 123/90.44; 123/90.46

[58] Field of Search ..... 123/90.27, 90.44, 90.43, 123/90.55, 90.22, 90.23, 90.4, 90.46

[56] References Cited

U.S. PATENT DOCUMENTS

| | | | |
|---|---|---|---|
| 1,382,953 | 6/1921 | Church | 123/90.44 |
| 1,406,271 | 2/1922 | Michelsen | 123/90.27 |
| 1,500,619 | 7/1924 | Hill | 123/90.44 |
| 2,944,536 | 7/1960 | Payne | 123/90.27 |
| 3,045,657 | 7/1962 | Sampietro | 123/90.44 |
| 4,267,811 | 5/1981 | Springer | 123/90.27 |
| 4,505,236 | 3/1985 | Nakamura | 123/90.27 |
| 4,553,515 | 11/1985 | King et al. | 123/90.27 |
| 4,556,025 | 12/1985 | Morita | 123/90.27 |

FOREIGN PATENT DOCUMENTS

| | | | |
|---|---|---|---|
| 504380 | 7/1920 | France . | |
| 1535881 | 8/1968 | France . | |
| 2091318 | 1/1972 | France . | |
| 43228 | 3/1980 | Japan | 123/90.27 |

*Primary Examiner*—Ira S. Lazarus

*Attorney, Agent, or Firm*—Burns, Doane, Swecker & Mathis

[57] ABSTRACT

A device for actuating valves in an internal combustion engine comprise four valves (9, 10, 11, 12) inclined in a V configuration and a central spark plug (3) per cylinder (6), each cylinder (6) being associated with two pairs of valves (9, 10; 11, 12) inclined on each side of an axial plane (PP) of the cylinder (6), while a spark plug pit (4) is provided between the two valves (9, 10) of one of the pairs, roughly parallel to the latter, this device comprising a central camshaft (13) located in the vicinity of the axial plane (PP) and, for each cylinder (6), at least two rockers (14, 15). There is interposed between each rocker (14, 15) and the camshaft (13) a pushrod (21) parallel to the cylinder (6), and, for each cylinder, the pin (18) of the rocker(s) disposed on the same side as the pit (4) is carried, as the other pin (19), by two bearings (26) located on each side of the rockers (14, 15) and is disposed between the pit (4) and the axial plane (PP). This device is of small overall size and particularly reliable.

12 Claims, 4 Drawing Figures

VALVE ACTUATING DEVICE IN AN INTERNAL COMBUSTION ENGINE HAVING FOUR VALVES INCLINED IN A V CONFIGURATION AND A CENTRAL SPARK PLUG PER CYLINDER

The invention relates to devices with which are provided some cylinder-heads of internal combustion engines and which actuate, in respect of each combustion chamber associated with a cylinder of the engine, two inlet valves and two exhaust valves disposed in a V configuration, i.e. inclined in pairs on each side of an axial plane of the cylinder, by means of a central overhead camshaft and at least two rockers.

As an ingition spark plug is arranged, for each cylinder in such manner that its electrodes are located, in the combustion chamber, in the vicinity of the axis of the cylinder, and therefore between the four valves, the spark plug is necessarily inclined, in the same way as a tubular pit providing access thereto, so as to pass close to the camshaft without touching it. This pit is therefore located between two of the four valves and between the two corresponding rockers.

In a known arrangement, this placement is rendered possible by pivotally mounting the two considered rockers on each side of the spark plug pit, each one being in overhanging relation on a pin parallel to the camshaft, or on a cylindrical or spherical pivot carried by a rod which is substantially parallel to the corresponding valve and fixed to the cylinder-head. These assemblies in an overhanging disposition or on a rod are liable to fail to provide sufficient reliability unless these pins and rods are amply dimensioned, which increases the weight, the overall size and the price of the cylinder-head.

An object of the invention is to provide, in an engine having four valves inclined in a V configuration and a central spark plug per cylinder, a device for actuating the valves which is of relatively small overall size and particularly reliable and optionally provided with means for taking up play which attenuates its operating noise.

The device according to the invention equips a cylinder-head in which each combustion chamber is associated with two pairs of valves, which are respectively inclined on each side of an axial plane of the corresponding cylinder, while a spark plug pit is disposed between the two valves of one of the two pairs in a position roughly parallel to these two valves.

The device comprises, for actuating the valves, a central camshaft located in the vicinity of said axial plane and, for each cylinder, at least two rockers which are spaced a greater distance away from the combustion chamber than the camshaft and which rock respectively on two pins parallel to the camshaft located on each side of said axial plane.

According to the invention, there is disposed between each rocker and the camshaft a pushrod which is substantially parallel to the cylinder, and, for each cylinder, the rocker pin disposed on the same side as the spark plug pit is carried, as the other pin, by two bearings located on each side of the rockers and disposed between the pit and said axial plane.

According to other advantageous features of the invention:

the two valves in the vicinity of the spark plug pit are respectively actuated by two rockers rocking on the same pin while the other pair of valves is actuated by a double rocker rocking on the seond pin, and the three rockers respectively cooperate with one of three parallel and aligned pushrods;

each pair of valves is actuated by one of two double rockers respectively rocking on one of the two pins and each cooperating with one of two parallel pushrods, one of the two rockers being astride the spark plug pit;

the pushrods located in the vicinity of said axial plane each slide in a guide which is in one piece with at least one of the two bearings carrying the corresponding rocker pin;

each of the pushrods has a hydraulic clearance taking-up device.

Two non-limiting embodiments of a device for actuating valves of an engine according to the invention will be described hereinafter, with reference to the accompanying drawings, in which.

Figure 1:
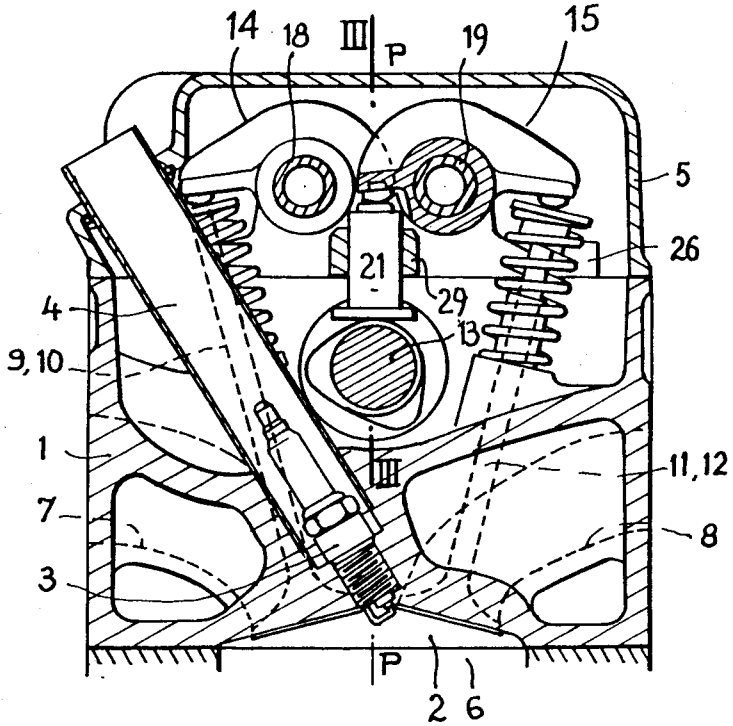
FIG. 1 is a side elevational view of a first embodiment of the actuating device according to the invention.

The device illustrated in the drawings comprises, in a cylinder-head 1 of an internal combustion engine, a combustion chamber 2 at the top of which is screwed an ignition spark plug 3 engaged in an inclined tubular pit 4 which extends through a cover 5 shown solely in FIG. 1. This chamber 2 is in facing relation to a cylinder 6 of the engine and opening onto this chamber are two inlet conduits 7 and two exhaust conduits 8 which are closable by valves 9, 10 and 11, 12, arranged in a V configuration, i.e. inclined in pairs on each side of a plane PP containing the axis of the cylinder 6. The electrodes of the spark plug 3 are approximately on the axis of the cylinder 6 and surrounded by the four valves 9–12. The pit 4 is located between the two inlet valves 9, 10 and is roughly parallel to the latter.

The valves 9–12 are actuated by a device comprising a central camshaft 13 whose axis is substantially perpendicular to the axis of the cylinder 6 and contained in the plane PP, and a plurality of rockers 14, 15 or 16, 17 each carried by one of two pins 18, 19 parallel to the camshaft. The rockers 14–17 are spaced at a greater distance from the chamber 2 than the camshaft 13 and are each connected to the latter by one of a plurality of pushrods 20, 21, 22 or 23, 24 parallel to the cylinder 6 and in alignment in the vicinity of the plane PP. The two pins 18, 19 are each carried by two bearings 25, 26 or 27, 28 fixed to the cylinder-head 1 on each side of the rockers 14–17 and are each located between the plane PP and one of the pairs of valves 9, 10 or 11, 12. The pin 18 located adjacent to the pit 4 of the spark plug extends on one side of the latter without touching it.

Figure 3:
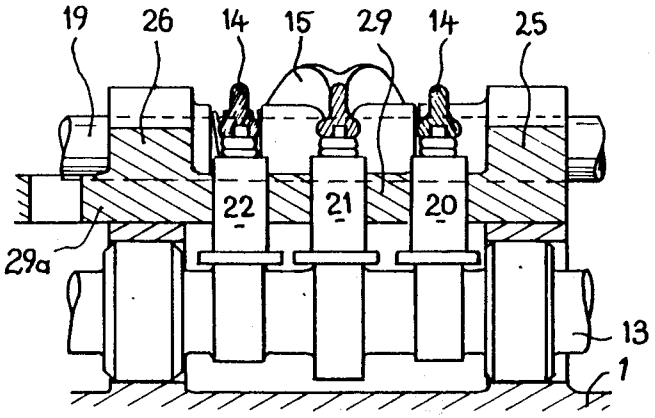
FIG. 3 is a partial sectional view taken on line III—III of FIG. 1.
Figure 2:
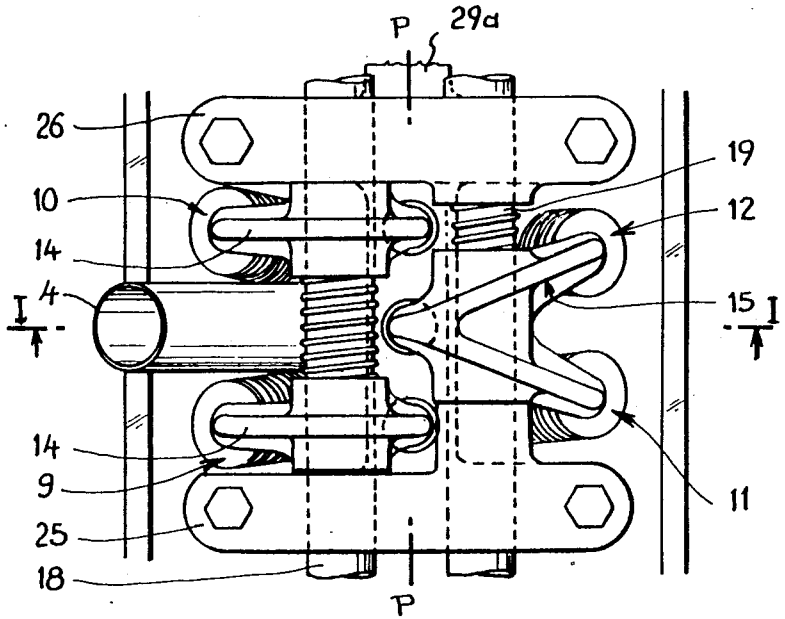
FIG. 2 is a top plan view of the device of FIG. 1, an upper component part of which has been removed.

The pushrods 20–24 each slide in a guide 29, 30 which is in one piece with at least one of the bearings 25 to 28. In the arrangement shown in FIGS. 1 to 3, each inlet valve 9, 10 is actuated by one of two rockers 14 rocking on the pin 18 on each side of the pit 4 and respectively cooperating with one of two pushrods 20, 22, while the two exhaust valves 11, 12 are actuated by a double rocker 15 rocking on the pin 19 and cooperating with a pushrod 21. The three pushrods 20, 21, 22 which are in alignment in the region of the plane PP, slide in a bar 29 constituting the aforementioned guide and being in one piece with the bearings 25, 26. In the case of an engine having a plurality of cylinders aligned to be parallel to the camshaft 13, this bar 29 is extended at one end 29*a* beyond at least one of the bearings 25, 26.

Figure 4:
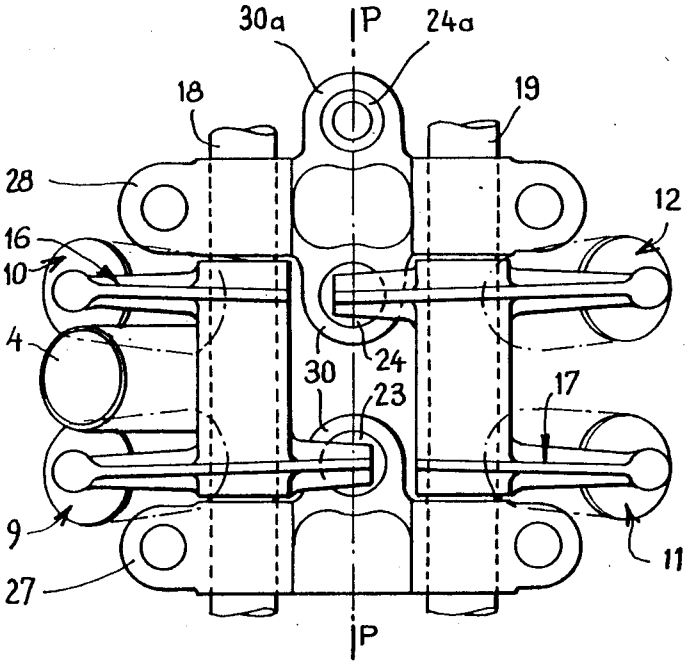
FIG. 4 is a view similar to FIG. 2 of a second embodiment of the device according to the invention.

In the embodiment shown in FIG. 4, each pair of valves 9–10, 11–12 is actuated by one of two double rockers 16, 17 respectively rocking on one of the two pins 18,19 and respectively cooperating with one of the two parallel pushrods 23, 24. The guide 30 of each of the latter is in one piece with a single one of the bearings 27, 28, a bearing such as 28 optionally including two guides 30, 30*a* for two pushrods 24, 24*a* respectively cooperating with rockers associated with two neighbouring cylinders. The fork formed by the double rockers 16 is astride the pit 4.

As can be seen in the drawings, the placement of the device in the cylinder-head 1 is relatively compact for an engine having four valves per cylinder and a central spark plug and, owing to the placement of the rocker pins within the V formed by the valves 9–12 and by the spark plug pit 4 in the part of this V which is sufficiently spaced away from the combustion chamber 2, and therefore sufficiently large, the pin located adjacent to the spark plug pit 4 does not interfere with the pit and can consequently be rigidly carried by two bearings. Further, the presence of the pushrods 20, 22 between the camshaft 18 and the rockers 14–17 enables the positioning in this V shaped space of a device for automatically taking up operational clearance of the valves by incorporating in each pushrod a known telescopic hydraulic shock-absorbing.

What is claimed is:

1. In a device in combination with an internal combustion engine for actuating valves in the internal combution engine which comprises four valves inclined in a V configuration and a central spark plug per cylinder, each cylinder being associated with two pairs of valves which are respectively inclined on each side of an axial plane of the corresponding cylinder, while a spark plug pit is provided between the two valves of one of the pairs and disposed substantially parallel to these pairs of valves, said device comprising a central camshaft located in the vicinity of said axial plane and, for each cylinder, at least two rockers which are spaced a greater distance away from the combustion chamber than the camshaft, and two pins which are parallel to the camshaft and located on each side of said axial plane, said rockers being respectively rockingly mounted on said pins; the improvement wherein a pushrod is interposed between each rocker and the camshaft and is disposed to be substantially parallel to the cylinder, and, for each cylinder, two bearings carry the rocker pin disposed on the same side as the spark plug pit and the other pin, the two bearings being located on each side of the rockers and disposed between the pit and said axial plane.

2. A device according to claim 1, wherein the two valves in the vicinity of the spark plug pit are respectively actuated by two rockers rocking on the same pin, while the other pair of valves is actuated by a double rocker rocking on the other pin, and the three rockers respectively cooperate with one of three parallel and aligned pushrods.

3. A device according to claim 2, wherein each of the pushrods includes a hydraulic clearance taking-up device.

4. A device according to claim 2, wherein a guide which is in one piece with at least one of the two bearings carrying the pin of the corresponding rocker slidingly supports each of the pushrods located in the vicinity of said axial plane.

5. A device according to claim 4, wherein each of the pushrods includes a hydraulic clearance taking-up device.

6. A device according to claim 1, wherein each pair of valves is actuated by one of two double rockers respectively rocking on one of the two pins and each cooperating with one of two parallel pushrods, one of the two rockers being astride the spark plug pit.

7. A device according to claim 6, wherein each of the pushrods includes a hydraulic clearance taking-up device.

8. A device according to claim 6, wherein a guide which is in one piece with at least one of the two bearings carrying the pin of the corresponding rocker slidingly supports each of the pushrods located in the vicinity of said axial plane.

9. A device according to claim 8, wherein each of the pushrods includes a hydraulic clearance taking-up device.

10. A device according to claim 1, wherein a guide which is in one piece with at least one of the two bearings carrying the pin of the corresponding rocker slidingly supports each of the pushrods located in the vicinity of said axial plane.

11. A device according to claim 10, wherein each of the pushrods includes a hydraulic clearance taking-up device.

12. A device according to claim 1, wherein each of the pushrods includes a hydraulic clearance taking-up device.

* * * * *